United States Patent [19]

Foltz

[11] Patent Number: 4,495,551

[45] Date of Patent: Jan. 22, 1985

[54] CONDUCTOR TUBE FOR FLASHLIGHTS

[75] Inventor: Carl L. Foltz, Largo, Fla.

[73] Assignee: Halkey-Roberts Corporation, St. Petersburg, Fla.

[21] Appl. No.: 524,097

[22] Filed: Aug. 17, 1983

[51] Int. Cl.[3] ..... F21L 7/00

[52] U.S. Cl. ..... 362/205; 362/204; 362/206; 362/208; 362/295; 362/457; 200/60; 72/369; 72/379

[58] Field of Search ..... 362/205, 204, 295, 208, 362/206, 457; 72/369, 379; 200/60

[56] References Cited

U.S. PATENT DOCUMENTS 3,806,724 4/1974 Tanner et al. ..... 362/189

4,408,263 10/1983 Sternlicht ..... 362/206

*Primary Examiner*—Stephen J. Lechert, Jr.

*Attorney, Agent, or Firm*—Stefan Stein

[57] ABSTRACT

A conductor tube for a battery operated flashlight is disclosed. The conductor tube comprises an inner non-conductive sleeve positioned within an outer conductive sleeve. The flashlight bulb-receiving end of the conductor tube includes a plurality of inwardly disposed lances which extend from the outer conductive sleeve through the inner non-conductive sleeve to electrically engage the base terminal of the light bulb. The lances may extend longitudinally with respect to the conductor tube to securely receive the base of the light bulb of the flashlight. Alternatively, the lances may extend substantially circumventially about the end of the conductor tube to threadably receive the base of the light bulb and establish electrical continuity therewith. A method is disclosed for producing the conductor tube of the invention in a progressive die from a ribbon of laminated conductive and non-conductive materials which will, when formed, constitute the outer conductive sleeve and the inner non-conductive sleeve, respectively.

17 Claims, 7 Drawing Figures

FIG. 1
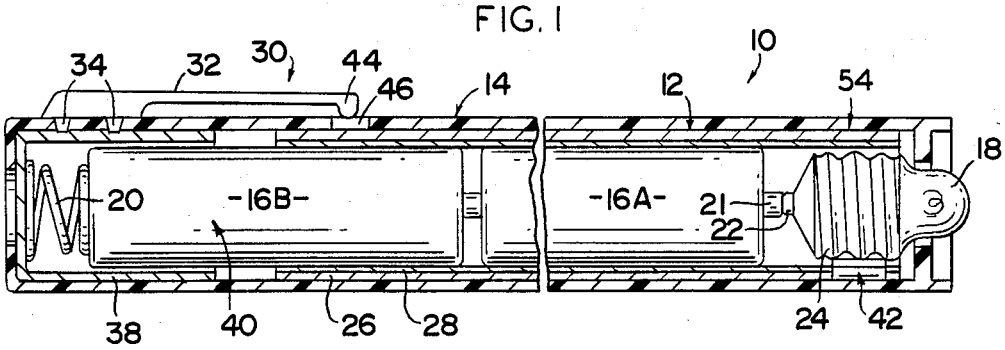
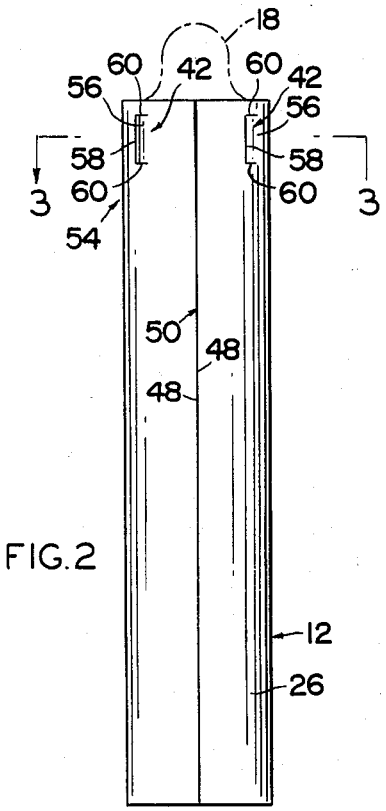
FIG. 2
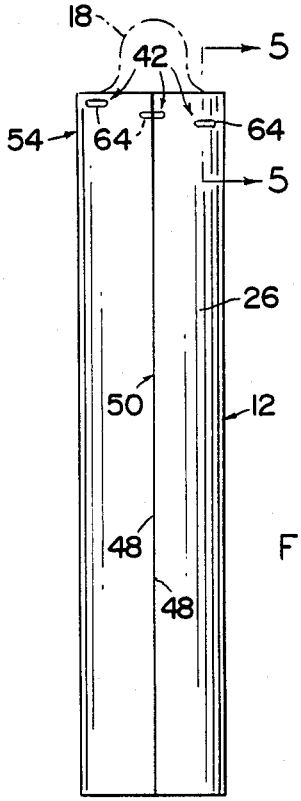
FIG. 4
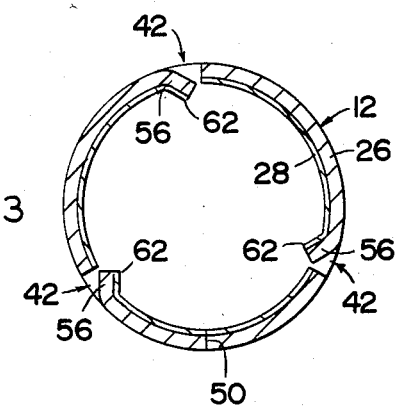
FIG. 3
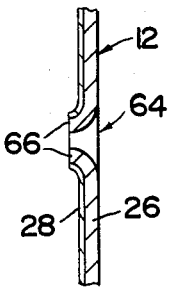
FIG. 5

CONDUCTOR TUBE FOR FLASHLIGHTS

BACKGROUND OF THE INVENTION

1. Field of the Invention

This invention relates to flashlights. More particularly, this invention relates to flashlight conductor tubes for receiving the batteries of the flashlight and for establishing electrical continuity between the switch and the bulb of the flashlight.

2. Description of the Prior Art

Flashlights typically comprise a tubular outer casing in which is stored one or more dry cell batteries, a light bulb and a switch for on-off operation of the flashlight. More particularly, there are usually two dry cell batteries which are connected in electrical series contact with one another, having one terminal in electrical contact with the base terminal of the light bulb and one terminal in electrical contact with one pole of the switch. The other pole of the switch is connected in electrical contact with the center terminal of the light bulb. In this configuration, actuation of the switch to an "on" position establishes electrical contact between the terminals of the batteries and the respective terminals of the light bulb, thereby causing the light bulb to light.

In small flashlights, commonly referred to as pocket or penlight flashlights, it has been found that the use of a conductor tube within the outer casing of the flashlight, and a corresponding conductor clip (operating as the switch), provides a convenient means for establishing the desired electrical continuity among the batteries, the switch, and the light bulb. Moreover, it is well known that the use of such conductor tubes has substantially reduced the cost of manufacturing such flashlights.

U.S. Pat. No. 1,839,971 issued to Korsen discloses a flashlight in which the conductor tube comprises a cylindrical or tubular non-conductive sleeve with a conductive strip disposed therein in direct electrical contact with one terminal of the battery. During use, the clip, operating as the switch, engages through an aperture in the non-conductive sleeve to make electrical contact with the conductive strip, thereby permitting the flow of electrical energy to the light bulb to light the same.

U.S. Pat. No. 1,219,109 issued to Kaplan teaches the use of a conductor tube having an inner conductive sleeve disposed within an outer non-conductive sleeve. The Kaplan conductor tube operates substantially similar to the Korsen tube by establishing the desired electrical continuity by means of a clip (operating as a switch), which engages through an aperture in the outer non-conductive sleeve to make contact with the inner conductive sleeve.

Finally, U.S. Pat. Nos. 3,806,724 and 3,902,058 issue to Tanner, et al. and Naylor, et al., respectively, teach the use of a conductor tube comprising a non-conductive, inner sleeve disposed concentrically within a conductive, outer sleeve with the non-conductive sleeve functioning to prevent electrical contact between the conductive sleeve and the conductive casing (cathode) of the battery, thereby eliminating the need for purchasing covered batteries. With the outer tubular casing of the flashlight comprising a non-conductive material, such as plastic, the clip (operating as a switch) engages through an aperture in the outer casing to engage the outer conductive sleeve, thereby completing the electrical circuit to energize the light bulb. More particularly, in these conductor tubes, electrical contact is established between the outer conductive sleeve and the base terminal of the light bulb by rolling in the end of the conductor tube into itself such that the end portion of the outer conductive sleeve is disposed on the lumen of the conductor tube. The light bulb is then fitted into this newly formed socket such that the base terminal of the light bulb is in direct electrical contact with the outer conductive sleeve of the conductor tube.

One major disadvantage to the conductor tube disclosed in the Tanner and Naylor patents listed above, is the necessity to roll in the end of the conductor tube into itself to establish electrical continuity with the base terminal of the light bulb and the outer conductive sleeve of the conductor tube. Experience has shown that the necessity of such rolled in end of the conductor tube dictates the material used for the outer conductive sleeve of the conductor tube. More particularly, experience has shown that the outer conductive sleeve must be manufactured from a relatively thin conductive material so that the end may be rolled in without breaking. Typically, such thin material comprises aluminum or copper having a thickness of approximately 0.001 inch. Because of the required thinness of the material constituting the outer conductive sleeve of the conductor tube, it has been found that the point of contact between the outer conductive sleeve and the clip, operating as a switch, tends to oxidize after relatively few operations of actuating the clip (switch) to engage the outer conductive sleeve. After oxidation, poor electrical contact is made between the clip and the outer conductive sleeve, thereby reducing the illumination emitted by the light bulb due to the reduction in the amount of electrical current flowing thereto.

Another major disadvantage to the conductor tube disclosed in the Tanner and Naylor patents listed above, is the great difficulty in manufacturing the same. Specifically, such conductor tubes are typically manufactured by laminating a layer of conductive material, such as aluminum foil, with a corresponding layer of non-conductive material, such as cardboard, and then rolling the same to produce a cylindrical configuration. The next step in the manufacturing process involves rolling in the end of the conductor tube to form the socket previously described. Obviously, this two-step process in manufacturing the conductive tube substantially increases the cost and complexity of producing the same.

Therefore, it is an object of this invention to provide an apparatus and method which overcomes the aforementioned inadequacies of the prior art conductor tubes and provides an improvement which is a significant contribution to the advancement of the art of producing conductor tubes for flashlights.

Another object of this invention is to provide a conductor tube for flashlights in which the outer conductive sleeve thereof is manufactured from a highly conductive material, such as tin-plated, low-carbon steel which is highly conductive and nonoxidizing to permit full electrical current to flow to the light bulb to energize the same.

Another object of this invention is to provide a conductor tube for a flashlight including means for establishing electrical contact between the base terminal of the light bulb and the outer conductive sleeve of the conductor tube without rolling in the end of the conductor tube as taught by the patents discussed above.

Another object of this invention is to provide a conductor tube for a flashlight including means for providing a socket for receiving the light bulb without rolling in the end of the conductor tube as taught by the patents listed above.

Another object of this invention is to provide a conductor tube for a flashlight having a configuration which is easily manufactured and less costly to produce as compared to the prior art conductor tubes discussed above.

Another object of this invention is to provide a method for manufacturing a conductor tube for a flashlight in which the conductor tube is continuously manufactured from a continuous ribbon of laminated materials, one material comprising a highly conductive, non-oxidizing material such as tin-plated, low-carbon steel, and the other material comprising a non-conductive material.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a conductor tube for a flashlight. More particularly, this invention comprises a conductor tube having an outer conductive sleeve manufactured from a highly conductive, non-oxidizing material such as tin-plated, low-carbon steel. The inside surface of the outer conductive sleeve is coated with a non-conductive material such as resin, lacquer or enamel. One end of the conductor tube includes a plurality of inwardly disposed lances which are formed in the conductor tube by a die-cutting punch. Preferably, the die-cutting punch produces the lances by piercing the conductive sleeve and the non-conductive coating so as to expose the inward, leading edge of the lance thus formed to the inside of the conductor tube. In the preferred embodiment, the lances are substantially elongated and extended longitudinally with respect to the conductor tube to securely receive the base of the light bulb of the flashlight, thereby establishing electrical continuity between the outer conductive sleeve and the base terminal of the light bulb via the inward, leading edge of the conductive sleeve. In another embodiment, the lances extend substantially circumventionally about the end of the conductor tube to threadably receive the base of the light bulb and establish electrical continuity therewith.

The invention further comprises a unique method for manufacturing the conductor tube. More specifically, the method of manufacture comprises the step of coating (laminating) a layer of the non-conductive material such as resin, lacquer or enamel onto the surface of a highly conductive, non-oxidizing material such as tin-plated, low-carbon steel. The sheet of laminated non-conductive and conductive materials is then cut to form a plurality of ribbons of laminant, each ribbon having a width appreciably greater than the desired length of the conductor tube. A ribbon of such laminant which will constitute the conductor tube is then fed continuously into a plurality of dies which first punch a pilot, locator hole and plurality of the lances as previously described. Subsequent dies are provided to selectively punch the ribbon into conductor tube blanks having the desired width and length dimensions, with each blank being retained to the carrier strips located on opposing sides of the blanks by interconnecting tabs. The retained blanks are then moved into a kick-down station which preforms the blank into a substantially U-shaped configuration. Subsequently, a pair of semi-circular forms move about the opposing sides of the U-shaped configuration blank and force the same into a cylindrical configuration upon closing. The manufacturing process of the conductor tube is then completed by moving the newly formed cylindrical tube into a trim station to release the tube from the carrier strips by cutting the aforementioned interconnecting tabs.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures and manufacturing methods for carrying out the same purposes of the present invention. It should also be realized by those skilled in the art that such equivalent constructions and methods do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a partial, longitudinal, cross-sectional view of a typical flashlight having the conductor tube of the invention incorporated therein.

FIG. 2 is a plan view of the conductor tube of the invention.

FIG. 3 is an enlarged cross-sectional view of FIG. 2 along lines 3—3 illustrating the cross-sectional configuration of the lances formed at the end of the conductor tube.

FIG. 4 is a plan view of a second embodiment of the conductor tube of the invention.

FIG. 5 is a partial, cross-sectional view of FIG. 4 along lines 5—5, illustrating the cross-sectional configuration of the lances formed at the end of the conductor tube.

Similar reference characters refer to similar parts throughout the several views of the drawings.

DETAILED DESCRIPTION OF THE PREFERRED EMBODIMENT

Figure 6:
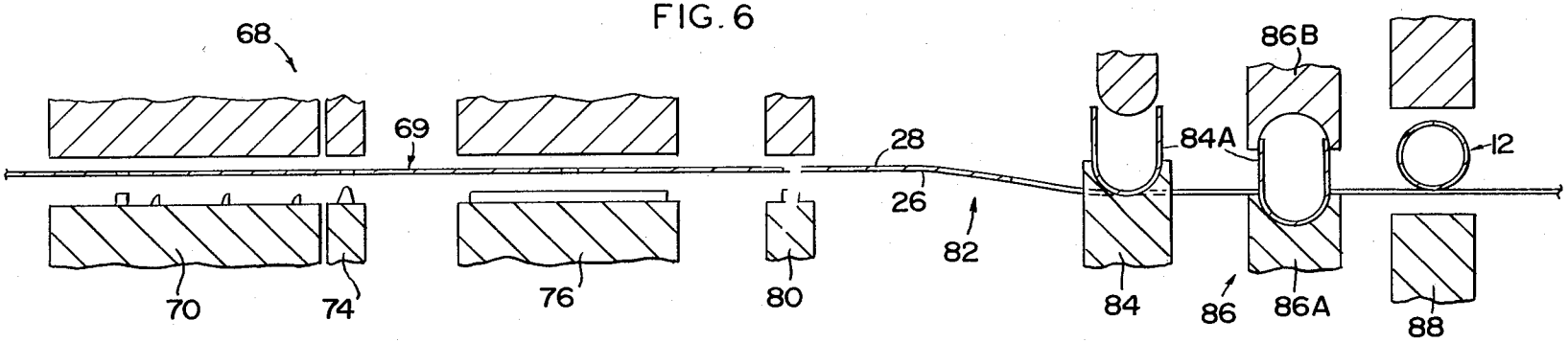
FIG. 6 is a schematic representation of the process for manufacturing the conductor tube of the invention.

FIG. 1 is a partial, longitudinal, cross-sectional view of a flashlight 10 having the conductor tube 12 of the invention incorporated therein. More particularly, typical flashlights 10 comprise an outer non-conductive tubular casing 14 dimensioned to house one or more dry cell batteries 16A and 16B positioned in series, and a light bulb 18. A spring 20 is provided to urge the batteries 16 toward the light bulb 18 such that the anode terminal 21 of the battery 16A is urged in electrical contact with the center terminal 22 of the light bulb 18.

The conductor tube 12 of the invention is positioned concentrically about the batteries 16A and 16B and the base terminal 24 of the light bulb 18. The conductor tube 12 comprises an outer conductive sleeve 26 and an inner non-conductive sleeve 28 (or coating hereinafter more fully described) which functions to provide electrical continuity between the base terminal 24 of the light bulb 18 and the switch, generally indicated by numeral 30. Preferably, switch 30 comprises a conventional clip 32 which is rigidly fastened to the tubular casing 14 by means of one or more prongs 34 which engage through the tubular casing 14 and are bent inward. A conductive thimble cap 38 is press-fitted into the end of the tubular casing 14 to be in direct electrical contact with the prongs 34 of the clip 32.

During use, the clip 32, operating as the switch 30, functions to provide electrical continuity between the cathode terminal 40 of the rearward battery 16B and the base terminal 24 of the light bulb 18 via the conductor tube 12. More specifically, the outer conductive sleeve 26 of the conductor tube 12 is in electrical contact with the base terminal 24 of the light bulb 18 by means of a plurality of lances 42 punched through the outer and inner sleeves 26 and 28 to engage the base terminal 24 of the light bulb 18. Accordingly, it is readily seen that the center terminal 22 of the light bulb 18 is in direct electrical contact with the anode terminal 21 of the batteries 16A and 16B placed in series, with the cathode terminal 40 of the rearward battery 16B being in electrical contact with clip 32 via the conductive thimble cap 38. Correspondingly, the base terminal 24 of the light bulb 18 is in direct electrical contact with the outer conductive sleeve 26 of the conductor tube 12 via lances 42.

During operation, the clip 32, operating as a switch 30, is depressed to move the tip 44 of the clip 32 through aperture 46 formed through outer tubular casing 14 to engage the outer conductive sleeve 26 of the conductor tube 12. In this actuated position, it is readily seen that electrical continuity is established between the base terminal 24 of the light bulb 18 and the cathode terminal 40 of the rearward battery 16B via the lances 42, the outer conductive sleeve 26, the clip 32, and the conductive thimble cap 38. Conversely, upon releasing the clip 32, the inherent resiliency of the clip 32 forces the tip 44 thereof to move out of contact with the outer conductive sleeve 26 of the conductor tube 12, thereby interrupting the flow of electrical current to the light bulb 18.

A more detailed explanation and description of alternative embodiments for conventional flashlights 10 including alternative embodiments for the outer casing, the switch (or a clip), spring, and thimble are disclosed in U.S. Pat. Nos. 1,839,971, 1,219,109, 3,806,724 and 3,902,058, the disclosure of each of which is hereby incorporated by reference herein.

FIG. 2 is a plan view of the preferred embodiment of the conductor tube 12 of the invention. More particularly, the conductor tube 12 comprises an outer sleeve 26 and an inner sleeve 28 as previously discussed which are laminated together. Preferably, however, the inner non-conductive sleeve 28 comprises a coating of a non-conductive material such as a resin, lacquer or enamel which adheres to the material constituting the outer sleeve 26. Also preferably, outer conductive sleeve 26 is manufactured from a highly conductive, non-oxidizing material such as tin-plated, low-carbon steel. Also preferably, the laminated outer and inner sleeve 26 and 28 are formed from a blank which has been formed into a cylindrical configuration whereby the opposing longitudinal edges 48 thereof meet along their entire length to form a non-connected seam 50.

A plurality of lances 42 are formed at the bulb-receiving end 54 of the conductor tube 12. As shown in FIGS. 2 and 3, the lances 42 of this preferred embodiment comprise inwardly extending projection 56 forced inwardly after cutting the conductor tube 12 at longitudinal cut 58 and transverse cut 60. When the projection 56 of the lance 42 is extended inwardly as shown in FIG. 3, it is readily apparent that the leading edge 62 thereof is sufficiently sharp to permit the base terminal 24 of the light bulb 18 to scrape off the inner sleeve coating 28 to expose and make electrical contact with the outer conductive sleeve 26. In fact, the sharpness of the leading edge 62 assures that the base terminal 24 of the light bulb 18 will be in solid electrical contact with the outer conductive sleeve 26. Additionally, the amount of force exerted by the leading edge 62 of the projection 56 in engaging the base terminal 24 of the light bulb 18 may be increased simply by undersizing the inner diameter of the conductor tube 12, and correspondingly, the inner diameter formed by the leading edges 62 of the lances 42 such that the conductive tube 12 appreciably flares at the bulb-receiving end 54 (via seam 50) when the light bulb 18 is inserted therein. Similarly, the other end of the conductor tube 12 may be flared about its periphery.

FIGS. 4 and 5 illustrate a second embodiment of the conductor tube 12 of the invention. More particularly, the second embodiment of the conductor tube 12 comprises a structure substantially identical to that described above for the preferred embodiment of the conductor tube 12, with the exception of the location and configuration of the lances 42. Specifically, the lances 42 of the second embodiment comprise a plurality of projections 64 disposed within the bulb-receiving end 54 of the conductor tube 12. The projections 64 are positioned transversely to the conductor tube 12 and are staggered with respect to one another so as to form a right-hand thread for threadably receiving the light bulb 18. Each of these projections 64 include an elongated, oval configuration with the center thereof removed by punching and the resulting peripheral inner edge thereof forced inwardly to create a leading edge 66.

During assembly, the light bulb 18 is threaded into the bulb-receiving end 54 of the conductor tube 12 by means of the projections 64 which form the thread. When threaded, it is apparent that the leading edge 66 of the outer conductive sleeve 26 (and the inner non-conductive sleeve 28) forceably engages the thread of the light bulb 18 to firmly establish direct electrical contact therewith. Similar to the first embodiment of the conductor tube 12, the internal diameter of the thread produced by the projections 64 may be appreciably smaller than the corresponding diameter of the thread of the light bulb 18 to cause flaring of the bulb-receiving end 54 of the conductor tube 12 at seam 50 when the light bulb 18 is threadably engaged therein, thereby rigidly securing the light bulb 18.

In each embodiment of the conductor tube 12, the projections 56 and 64 preferably do not extend further along the bulb-receiving end 54 of the conductor tube 12 to assure that the lances 42 engage only the base terminal 24 of the light bulb 18 and not the cathode terminal 40 of the forward battery 16A.

Figure 7:
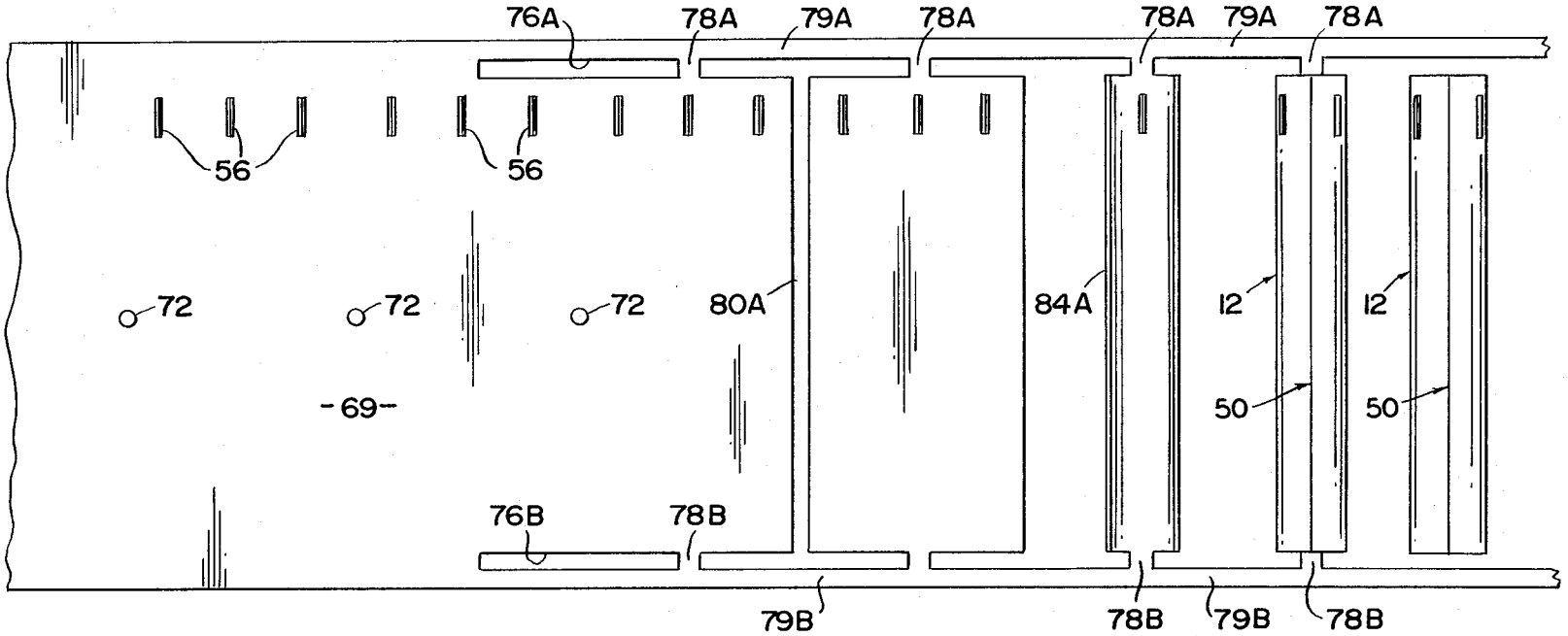
FIG. 7 is a plan view of the ribbon laminant, illustrating the various steps performed thereon during the manufacturing process.

FIGS. 6 and 7 illustrate a unique method for manufacturing the preferred embodiment of the conductor tube 12 of the invention. Specifically, the first step of the manufacturing process is to coat (laminate) a layer of a non-conductive material such as resin, lacquer or enamel (preferably non-transparent) constituting the inner sleeve 28 onto the surface of a highly conductive, non-oxidizing material such as tin-plated, low-carbon steel constituting the outer sleeve 26. This sheet of laminated material is then strip-cut into a plurality of ribbons of laminant, each ribbon laminant having a width appreciably greater than the desired length of the conductive tube 12. A ribbon 69 of such laminant which will constitute the conductor tube 12 is then fed continuously into a progressive die 68 having a number of smaller dies to perform the following operations.

First, die 70 operates to punch a locator, pilot hole 72 and three of the projections 56 (shown as the preferred embodiment, but understood to alternatively include the second embodiment). The next station comprises a locator 74 to locate the pilot hole 72 to center the ribbon 69 with respect to the progressive die 68. In the next operation, another die 76 is provided to die-cut slots 76A and 76B on opposing sides of the pilot hole 72, with the distance between the slots 76A and 76B determining the overall length of the conductor tube 12 and with the segments between each respective slot 76A and 76B functioning as connecting tabs 78 to connect the blank to the carrier strips 79A and 79B formed on opposing sides of the blank. A transverse slot 80A is then die-cut in a succeeding station by a similar die-cutter 80. The next incremental station is merely a dead station 82 during which no activity is performed on the ribbon 69. After this dead station 82, the ribbon 69 feeds into a kick-down, preform station 84 which preforms the blank formed by the previous operations into a substantially U-shaped configuration 84A. The U-shaped configuration 84A is then moved into a final form station 86 which comprises two semi-circular forms 86A and 86B which move about the U-shaped configuration 84 to force it into a substantially cylindrical configuration. Finally, the ribbon 69 is moved into a trim station 88 which trims the tabs 78A and 78B from the cylindrical configuration thereby releasing the completed conductor tube 12 from the carrier strips 79A and 79B.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described, I claim:

1. A battery operated flashlight, comprising in combination:

a casing;

a two-pole switch means having a first pole connected in electrical contact with one terminal of the battery and a second pole;

a light bulb having a base terminal and a center terminal;

means for connecting another terminal of the battery to the center terminal of said light bulb;

a substantially cylindrical conductor tube having a bulb-receiving end for receiving said base terminal of said light bulb and for providing electrical contact between the base terminal of said light bulb and the second pole of said switch means when said switch means is actuated to an "on" position;

said conductor tube comprising an inner non-conductive sleeve and an outer conductive sleeve;

said base terminal of said light bulb being positioned within said bulb-receiving end of said conductor tube; and said conductor tube further comprising at least one lance extending from said outer conductive sleeve in electrical contact with said base terminal of said light bulb fitted into said bulb-receiving end of said conductor tube.

2. The flashlight as set forth in claim 1, wherein said lance of said conductor tube includes a projection which extends inwardly from the bulb-receiving end of said conductor tube to engage said base terminal of said light bulb.

3. The flashlight as set forth in claim 2, wherein said projection of said lance is formed longitudinally within said conductor tube.

4. The flashlight as set forth in claim 3, wherein said projection is formed by longitudinally cutting and transversely cutting through said conductor tube and forcing the projection inwardly such that the leading edge thereof rigidly engages said base terminal of said light bulb positioned within said bulb-receiving end of said conductor tube.

5. The flashlight as set forth in claim 4, comprising a plurality of said lances each including one of said projections, and wherein the inner diameter formed by the leading edges of said projection is smaller than the outermost diameter of said base terminal of said light bulb whereby said bulb-receiving end of said conductor tube appreciably flares when said light bulb is positioned therein.

6. The flashlight as set forth in claim 2, comprising a plurality of said lances each including one of said projections and wherein said projections of said lances are formed within said bulb-receiving end of said conductor tube and positioned relative to one another so as to form a thread within said bulb-receiving end of said conductor tube thereby permitting said light bulb to threadably engage said bulb-receiving end of said conductor tube.

7. The flashlight as set forth in claim 6, wherein said projections are each formed by cutting an aperture through said bulb-receiving end of said conductor tube and inwardly flaring the peripheral inner edge of said aperture so as to form a leading edge for electrical engagement with said base terminal of said light bulb when said light bulb is positioned within said bulb-receiving end of said conductor tube.

8. The flashlight as set forth in claim 7, wherein the inner diameter formed by the leading edges of said projections is smaller than the innermost diameter of said base terminal of said light bulb whereby said bulb-receiving end of said conductor tube appreciably flares when said light bulb is threadably engaged therein.

9. A conductor tube for a battery operated flashlight, the flashlight including a casing, a two-pole switch means having a first pole connected in electrical contact with one terminal of the battery and a second pole, a light bulb having a base terminal and a center terminal, means for connecting another terminal of the battery to the center terminal of the light bulb, the conductor tube comprising a substantially cylindrical design having a bulb receiving end for receiving the base terminal of the light bulb, an inner non-conductive sleeve and an outer conductive sleeve, and at least one lance extending from said outer conductive sleeve through said inner non-conductive sleeve, whereby, upon fitting of the light bulb into said bulb-receiving end of said conductor tube, said lance engages the base terminal of the light bulb to electrically connect said outer conductive sleeve to the base terminal of the light bulb such that the base terminal of said light bulb and the second pole of said switch means are electrically connected when said switch means is actuated to an "on" position.

10. The flashlight as set forth in claim 9, wherein said lance of said conductor tube includes a projection which extends inwardly from the bulb-receiving end of said conductor tube to engage said base terminal of said light bulb.

11. The flashlight as set forth in claim 10, wherein said projection of said lance is formed longitudinally within said conductor tube.

12. The flashlight as set forth in claim 11, wherein said projection is formed by longitudinally cutting and transversely cutting through said conductor tube and forcing the projection inwardly such that the leading edge thereof rigidly engages said base terminal of said light bulb when said light bulb is positioned within said bulb-receiving end of said conductor tube.

13. The flashlight as set forth in claim 12, wherein the inner diameter formed by the leading edges of said projection is smaller than the outermost diameter of said base terminal of said light bulb whereby said bulb-receiving end of said conductor tube appreciably flares when said light bulb is positioned therein.

14. The flashlight as set forth in claim 10, wherein said projection of said lance is formed within said bulb-receiving end of said conductor tube and positioned relative to one another so as to form a thread within said bulb-receiving end of said conductor tube thereby permitting said light bulb to threadably engage said bulb-receiving end of said conductor tube.

15. The flashlight as set forth in claim 14, wherein said projection is formed by cutting an aperture through said bulb-receiving end of said conductor tube and inwardly flaring the peripheral inner edge of said aperture so as to form a leading edge for electrical engagement with said base terminal of said light bulb when said light bulb is positioned within said bulb-receiving end of said conductor tube.

16. The flashlight as set forth in claim 15, wherein the inner diameter formed by the leading edges of said projection is smaller than the innermost diameter of said base terminal of said light bulb whereby said bulb-receiving end of said conductor tube appreciably flares when said light bulb is threadably engaged therein.

17. A method for producing a conductor tube for use in conjunction with a battery operated flashlight, the flashlight including a casing, a two-pole switch means having a first pole connected in electrical contact with one terminal of the battery and a second pole, a light bulb having a base terminal and a center terminal, means for connecting another terminal of the battery to the center terminal of the light bulb, the method comprising the steps of:

providing a laminated ribbon of material, the material comprising an inner non-conductive material and an outer conductive material, and the ribbon including a width appreciably greater than the desired length of the conductor tube;

forming a series of lances in said ribbon along one edge thereof;

forming a series of longitudinal slots longitudinally on opposing edges of the ribbon and a series of transverse slots in the ribbon which define conductor tube blanks with the distance between the opposing longitudinal slots defining the length of the conductor tube and the segments between the series of longitudinal slots functioning as tabs to connect the conductor tube blanks to the resulting carrier strips on opposing edges of the ribbon;

preforming each conductor tube blank into a substantially U-shaped configuration;

final forming each conductor tube blank into a substantially cylindrical configuration; and trimming the tabs from each conductor tube blank to release the substantially cylindrical configuration from the carrier strips.

* * * * *